US006321928B1

(12) United States Patent
Goldenstein et al.

(10) Patent No.: US 6,321,928 B1
(45) Date of Patent: Nov. 27, 2001

(54) ENCLOSURE MOUNTING PAD WITH SUPPORT BASE

(75) Inventors: Kim M. Goldenstein; George T. Lowe, both of San Diego, CA (US); Douglas R. Moore, Ault, CO (US); Donald J. Pagano, Escondido, CA (US)

(73) Assignee: V.I.T. Products, Inc., Escondido, CA (US)

( * ) Notice: Subject to any disclaimer, the term of this patent is extended or adjusted under 35 U.S.C. 154(b) by 0 days.

(21) Appl. No.: 09/698,634

(22) Filed: Oct. 27, 2000

(51) Int. Cl.[7] ..... B65D 88/76
(52) U.S. Cl. ..... 220/484
(58) Field of Search ..... 220/484, 243, 220/245, 248; 52/19, 20

(56) References Cited

U.S. PATENT DOCUMENTS

| | | | | |
|---|---|---|---|---|
| Re. 31,134 | | 1/1983 | Lux, Jr. | 336/65 |
| 343,933 | * | 6/1886 | Walker | 220/484 |
| 758,114 | | 4/1904 | Shertzer . | |
| 1,746,700 | * | 2/1930 | Jacobus | 220/245 |
| 3,841,032 | | 10/1974 | Grannis, III | 52/27 |
| 3,962,660 | | 6/1976 | Duckett | 336/65 |
| 4,056,251 | | 11/1977 | Dixon et al. | 248/19 |
| 4,145,857 | | 3/1979 | Tilsen | 52/285 |
| 4,213,111 | | 7/1980 | Lux, Jr. | 336/65 |
| 4,465,039 | * | 8/1984 | Snelgrove et al. | 123/142.5 E |
| 4,644,095 | | 2/1987 | Bright et al. | 174/50 |
| 5,291,845 | * | 3/1994 | Vallery | 114/203 |
| 5,587,554 | | 12/1996 | Kendrick, Jr. | 174/37 |
| 5,951,200 | * | 9/1999 | Barton | 404/25 |
| 6,164,131 | * | 12/2000 | Edwards et al. | 73/277 |

OTHER PUBLICATIONS

Associated Plastics, Inc., Product Catalog, 16 pgs., date unknown.
Newbasis, Plastic Products Catalog, 74 pgs., 2000.

* cited by examiner

*Primary Examiner*—Stephen Castellano
(74) *Attorney, Agent, or Firm*—Knobbe Martens Olson & Bear LLP

(57) ABSTRACT

An enclosure installation assembly comprises a support base and a mounting pad adapted to be secured to the support base. The support base, having a lower portion slightly larger than its upper portion, is placed in a hole in the ground. Dirt is compacted around the support base to secure the support base in place. The mounting pad is then secured to the support base using support braces that internally engage the support base and fasteners that engage the mounting pad. Finally, an enclosure is installed on the mounting pad, with fasteners located inside the enclosure. The resulting enclosure is securely and easily installed, and is tamper resistant.

27 Claims, 7 Drawing Sheets

ENCLOSURE MOUNTING PAD WITH SUPPORT BASE

BACKGROUND OF THE INVENTION

1. Field of the Invention

The invention relates generally to enclosures for securely housing a variety of instruments including electrical systems and electronic controls. In particular, the invention relates to an enclosure mounting pad with a support base for simple and secure installation of enclosures.

2. Description of Related Technology

Enclosures are used by irrigation, plumbing and electrical industry professionals to mount and protect electronic controls as well as backflow prevention devices. These enclosures are often located in an easily accessible, outdoor location. Typically, such electronic controls are located inside a metal box-like structure that securely encloses the controls along with a locking door for access. The enclosures are sometimes large enough to house not only the controls, but also other items such as tools.

The enclosures are located above ground, usually placed on either a grassy or a dirt surface. Thus, vandals and thieves are able to easily uproot the enclosure from the ground and damage, steal or abuse the contents of the enclosure. To solve this problem, a concrete slab is formed on the ground, attached to a support base, and the enclosure is then installed on the concrete slab. However, this solution requires that the ground first be prepared and equipment be obtained for the pouring of concrete at the site. Alternatively, the concrete slab is preformed for installation at the site, requiring highly precise preforming to fit the particular site and the particular enclosure, and heavy equipment to transfer and install the slab at the site.

In come cases, fiberglass mounts are also used. These fiberglass mounts, while lighter and easier to install, also deteriorate upon exposure to ultraviolet (UV) radiation and are easily tampered with.

The concrete slab or fiberglass mount are typically secured to a support base using bolts or similar attachment means. The bolts securing the mount are located above ground and outside the enclosure, where they are exposed to the elements and easily accessed by vandals.

Thus, there is a need for an enclosure support that provides for a simple, yet secure, installation of the enclosure that is vandal-resistant.

SUMMARY OF THE INVENTION

Disclosed herein is an enclosure mounting assembly, and a method of installing the assembly. The invention provides for a secure installation of the enclosure, which is weatherproof, prevents corrosion, and is resistant to vandals and thieves.

In one embodiment, the enclosure mounting assembly comprises a support base having a bottom, a top and a substantially hollow interior, and a mounting pad resting on top of the support base. The mounting pad has an opening in its substantially flat top surface. At least one support brace is used to clamp an upper portion of the support base between the support brace and said mounting pad, thus securing the parts together.

Preferably, the support base has a rectangular footprint, and is made of plastic. The mounting pad is preferably made of metal, and more preferably, marine-grade aluminum. It is preferred that the mounting pad is a rectangular plate.

The assembly can further comprise a fastener for securing the support brace, support base and mounting pad together. The fastener is preferably a nut and bolt assembly. The mounting pad can include a hole in its top surface for receiving the fastener.

In a preferred embodiment, strengthening flanges are located on the support base to provide extra support. The support base bears the weight of the mounting pad, which rests on a top edge of the support base. The support base preferably includes a ledge located on an upper interior surface; the support brace is secured beneath the ledge. The support brace preferably has a U-shaped cross-section.

In another embodiment of the invention, there is disclosed a method of securely installing an enclosure mounting pad on an area of ground. The method comprises digging a hole in the ground to accommodate the support base; inserting the support base in the hole, the support base having a top, a bottom and an interior; placing a mounting pad on top of the support base, the mounting pad having an opening in a top surface; and clamping an upper portion of the support base between a support brace and the mounting pad.

In a preferred embodiment, the method also includes mounting an enclosure on top of the mounting pad, and securing it in place using a fastener. Advantageously, the fastener is located in the interior of the enclosure. The fastener is inserted through a hole provided in the support brace and a hole provided in the mounting pad to secure the support brace, support base and mounting pad together.

To provide for additional security and to minimize rodent and moisture problems, the interior of the support base can be filled with a filler, and the hole can be backfilled after inserting the support base.

In yet another embodiment of the invention, there is provided an enclosure assembly. The assembly comprises a support base having a bottom, a top and a hollow interior; a mounting pad resting on top of the support base, the mounting pad having an opening in a top surface; at least one support brace clamping an upper portion of the support base between the support brace and the mounting pad; and an enclosure having a base mounted on the top surface of the mounting pad, the enclosure having an opening in the base sized so as to surround the opening in the top surface of the mounting pad.

Preferably, at least one fastener is used to secure the support brace, the support base, the mounting pad and the enclosure together. The fastener is advantageously located in an interior of the enclosure, which is preferably a metal cabinet. The mounting pad and the enclosure each have at least one hole therein for receiving the fastener. The fastener is preferably a nut and bolt assembly.

If desired, the mounting pad can include a plurality of openings in its top surface, to accommodate more than one enclosure. The support base is preferably made of plastic, while the mounting pad is preferably made of metal, and more preferably, marine-grade aluminum.

DETAILED DESCRIPTION OF THE INVENTION

Reference is now made to the drawings wherein like numerals refer to like parts throughout.

Figure 1:
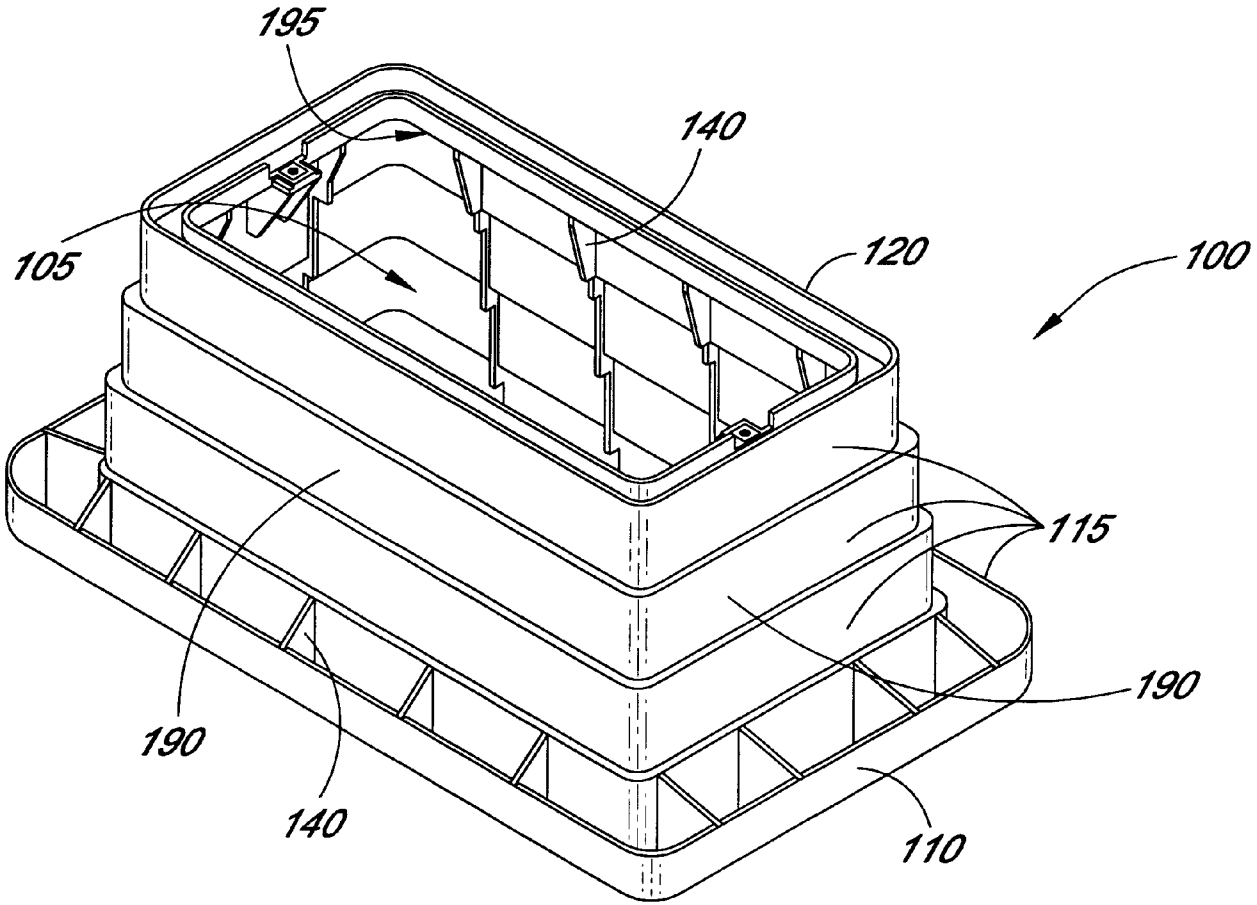
FIG. 1 is a perspective view of a support base for an enclosure according to one embodiment of the invention.

FIG. 1 illustrates one embodiment of a support base 100 for use in a system for supporting and installing enclosures. A preferred support base of the type described below is commercially available from Associated Plastics, Riverside, Calif. As illustrated, the support base 100 is made of several tiers of rectangular-shaped frames 115, stacked upon one another. The size of the frames 115 gradually decreases from bottom to top of the support base 100. The support base 100 is preferably made of a heavy-duty plastic, but may also be formed of fiberglass, metal or any other suitable material. While the support base 100 as illustrated in the figures has several tiers, it is not essential that the support base 100 be so formed. Any support that is larger at its base than at its top and is capable of supporting the weight of the enclosure and mounting pad can be used. It is to be understood that the tiered support is for illustrative purposes only.

The support base 100 preferably has an open bottom (not shown in FIG. 1) and an open top 105 and is hollow throughout. The support base 100 has four side surfaces 190 forming the sides of a rectangular box, and a base 110. The base 110 is the largest of the tiers and forms a relatively large rectangular shape that forms the bottom of the four side surfaces 190 of the rectangular box. The support base 100 is designed to support the mounting pad and the enclosure. Strengthening flanges 140 can be provided at the base 110 to provide additional strength, allowing the support base 100 to support the mounting pad and the enclosure.

As shown in the drawing, The first frame 115 is located above the base 110. The first frame 115 has a rectangular footprint that is smaller than that of the base 110. Thus, the footprint of the first frame 115 is a rectangle located inside another rectangle representing the footprint of the base layer 110. Similarly, a second and a third frame 115 are provided above the first frame 115, each having a successively smaller rectangular footprint. Each frame 115 has its rectangular footprint within the rectangular footprint of the preceding frame 115. The height of each of the frames may be designed to provide a desired height for the support base 100, the height being selected to provide sufficient stability when the support base 100 is installed. This configuration provides the support base 100 with a somewhat conical profile. According to the embodiment illustrated in FIG. 1, each side surface 190 is provided with three vertical portions 115. However, it is understood that any number of vertical portions 115 can be used to form the side surfaces 190. Alternatively, the side surfaces 190 can be continuous smooth surfaces forming a truncated pyramidal shape. Additionally, it is understood that the support base 100 need not be of a rectangular shape; various shapes can be used, including but not limited to any polygonal cone or a purely circular cone.

Preferably, strengthening flanges 140 are provided on the inside and/or outside surface of the support base 100. The flanges 140 run substantially vertically along the side surfaces 140 of the support base 100. The flanges 140 provide support for the vertical portions 115 of the four side surfaces 190.

Figure 2:
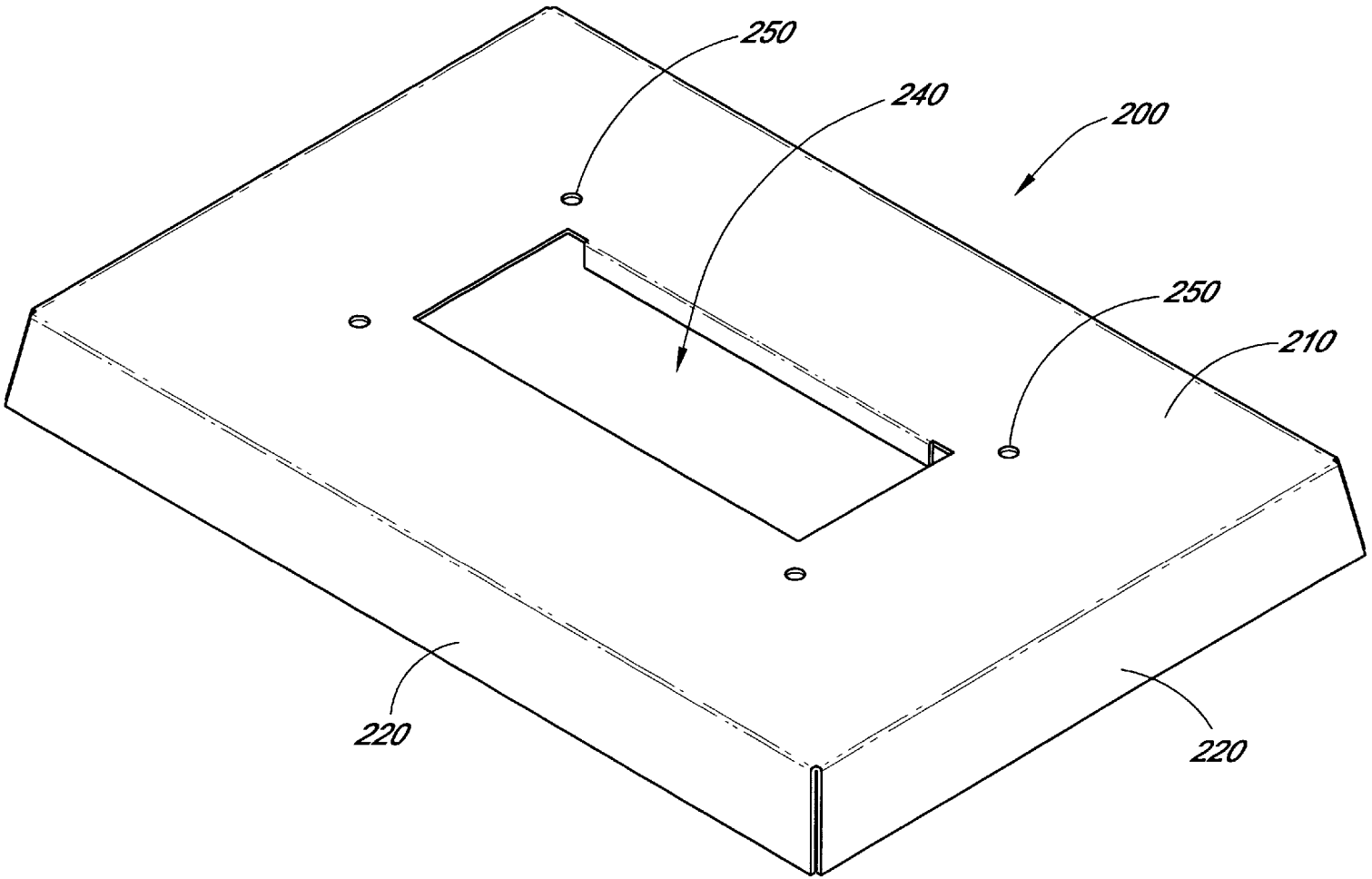
FIG. 2 is a perspective view of a mounting pad for an enclosure for use with the support base of FIG. 1.

A ledge 195 is located on the interior surface of the support base 100, near the top edge 120. The top edge 120 is preferably of a substantially rectangular shape. The top edge 120 of the uppermost vertical portion 115 serves as a resting surface for a mounting pad. One embodiment of a mounting pad 200 is illustrated in FIG. 2 and will be described here with reference to FIG. 2.

The mounting pad 200 is a substantially rectangular plate with a flat top surface 210. The mounting pad 200 is preferably made of a metallic material such as steel or aluminum or a UV-stabilized plastic. A preferred embodiment of the mounting pad 200 is made from 3/16-inch thick, marine-grade aluminum. Aluminum is preferred, as it provides several advantages over other materials. It has the ability to provide protection against lightening strikes, thereby preventing damage to the enclosure and its contents. Additionally, marine-grade aluminum provides increased resistance to corrosion. In areas where lightening strikes are not a concern, UV-stabilized plastic can be used, thereby reducing costs of manufacture.

The mounting pad 200 is provided with an edging 220 that is formed perpendicular to the plane of the top surface 210. An opening 240 is provided near the center of the top surface 210 of the mounting pad 200. The opening 240 is sized so as to fit within the base of the enclosure 300 (see FIG. 6). Multiple openings can be provided, if desired, to accommodate multiple enclosures (see FIG. 7). In addition, the size and shape of the opening 240 may be varied to meet specific needs. The opening 240 in the mounting pad 200 should be sized to allow passage of the pipes, cables 310, and the like from the interior of the enclosure 300 into the ground below (see FIG. 3).

One or more holes 250 are provided on the top surface 210 of the mounting pad 200 around the opening 240. These holes 250 are adapted to receive fasteners, such as bolts or screws, used to secure the enclosure to the mounting pad 200 and the support base 100. Preferably, the through holes 250 are provided with rubber grommets (not shown) to keep the fasteners in place during the installation process.

Figure 3:
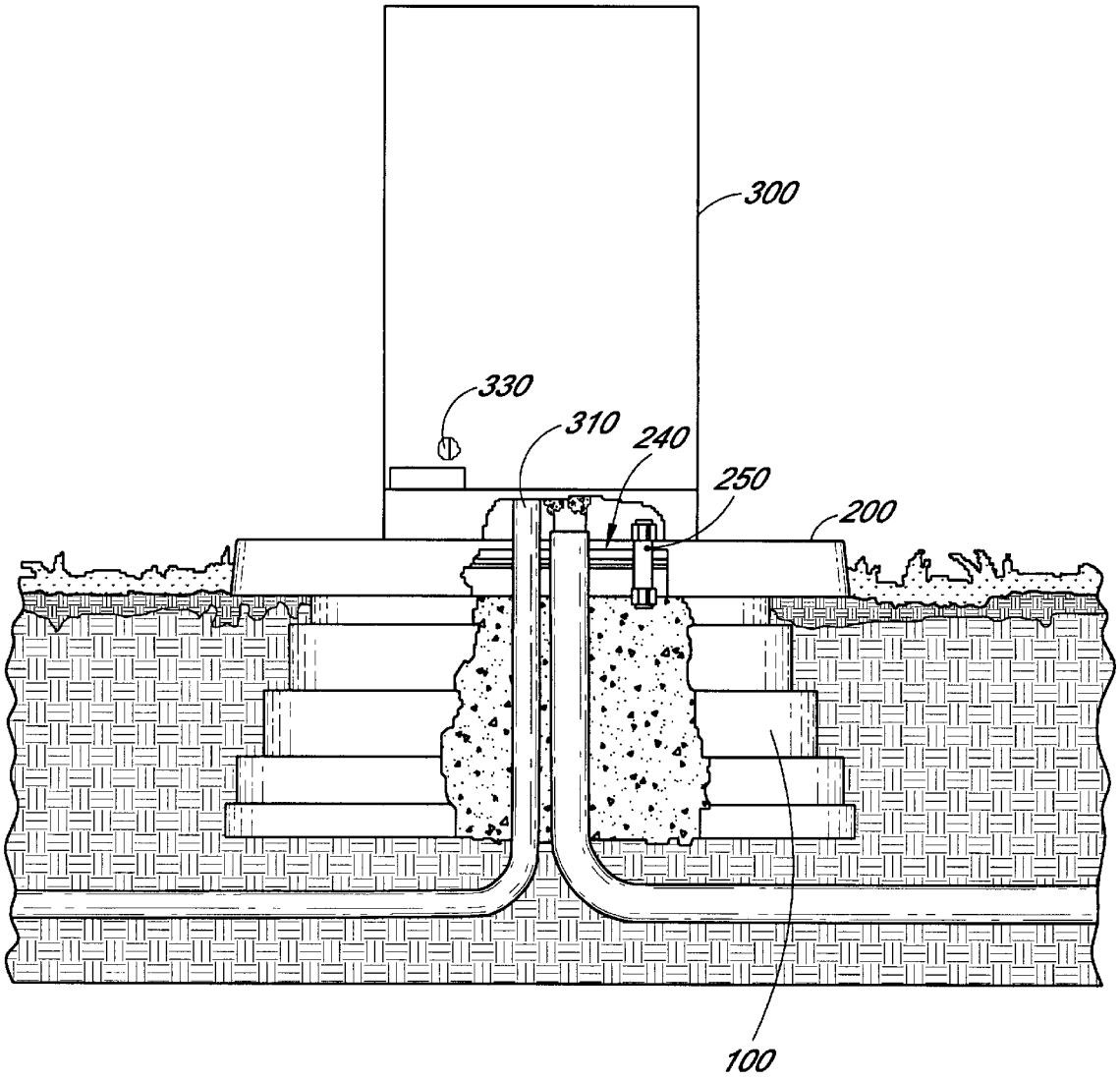
FIG. 3 is a partially cut-away view of a secure enclosure support system that includes the support base of FIG. 1 and the mounting pad of FIG. 2.

FIGS. 3–6 illustrate the engagement of the support base 100, the mounting pad 200 and an enclosure 300. FIG. 3 illustrates the support system and the enclosure installed. Prior to installation, a hole roughly the shape of and slightly larger than the size of support base 100 is dug in the ground to accommodate the support base 100. The location of the hole can be determined by the location of the pipes and cables 310 used, for example, to provide controls for a landscaping irrigation system. Once the hole is dug, the support base 100 is inserted into the hole. Preferably, approximately three inches of the support base 100 are left above ground to facilitate installation of the mounting pad 200. The inside of the support base 100 is then preferably filled with pea gravel or other filler to minimize rodent and moisture problems. Alternatively, the pea gravel can be added after the installation of the enclosure. This allows for the movement of the pipes and cables 310 during installation. Once the support base 100 is in position, dirt is backfilled and compacted around the outside of the support base 100. This secures the support base 100 in its location.

Figure 4:
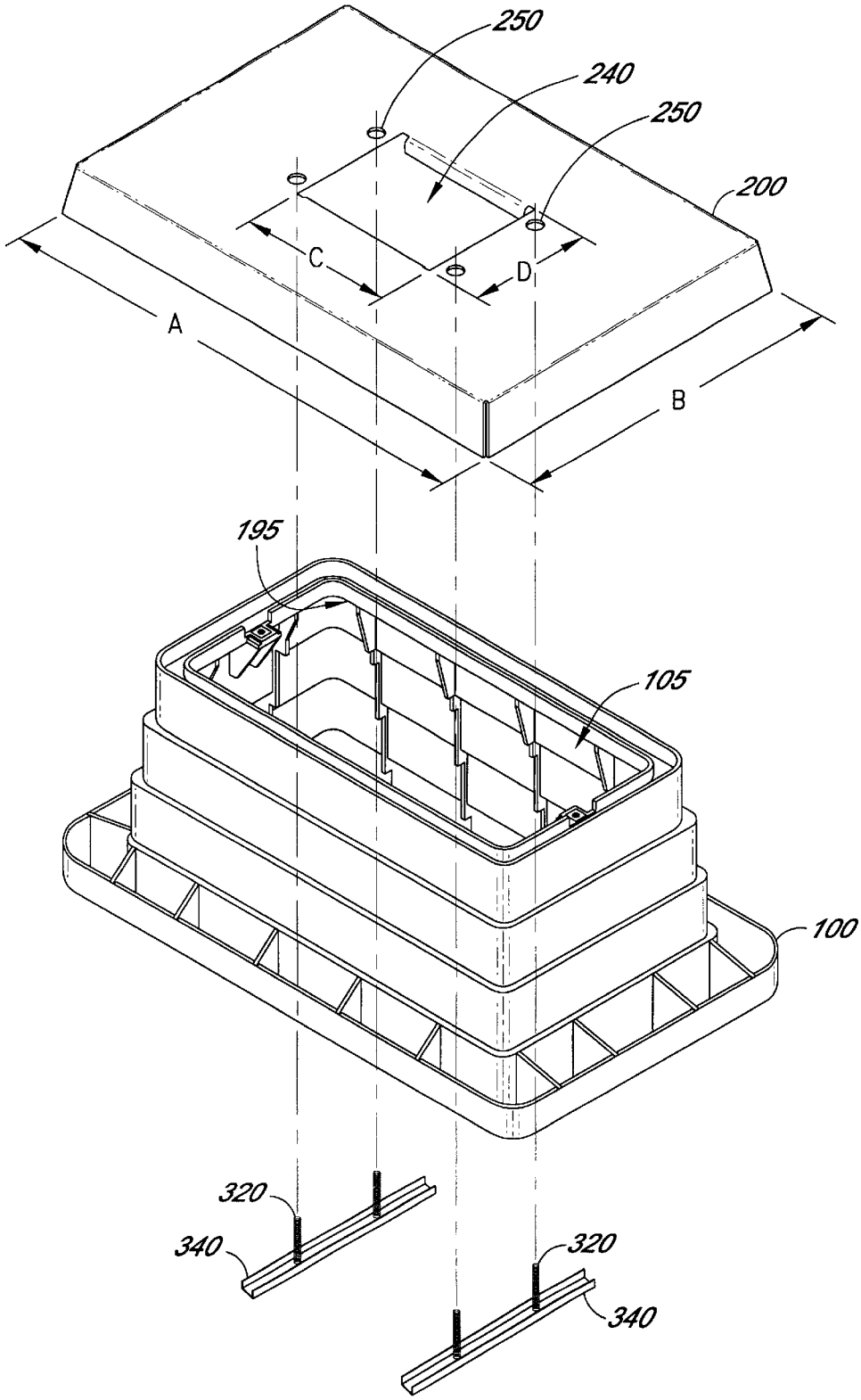
FIG. 4 is an exploded view of an enclosure support system using the support base of FIG. 1 and the mounting pad of FIG. 2.
Figure 5:
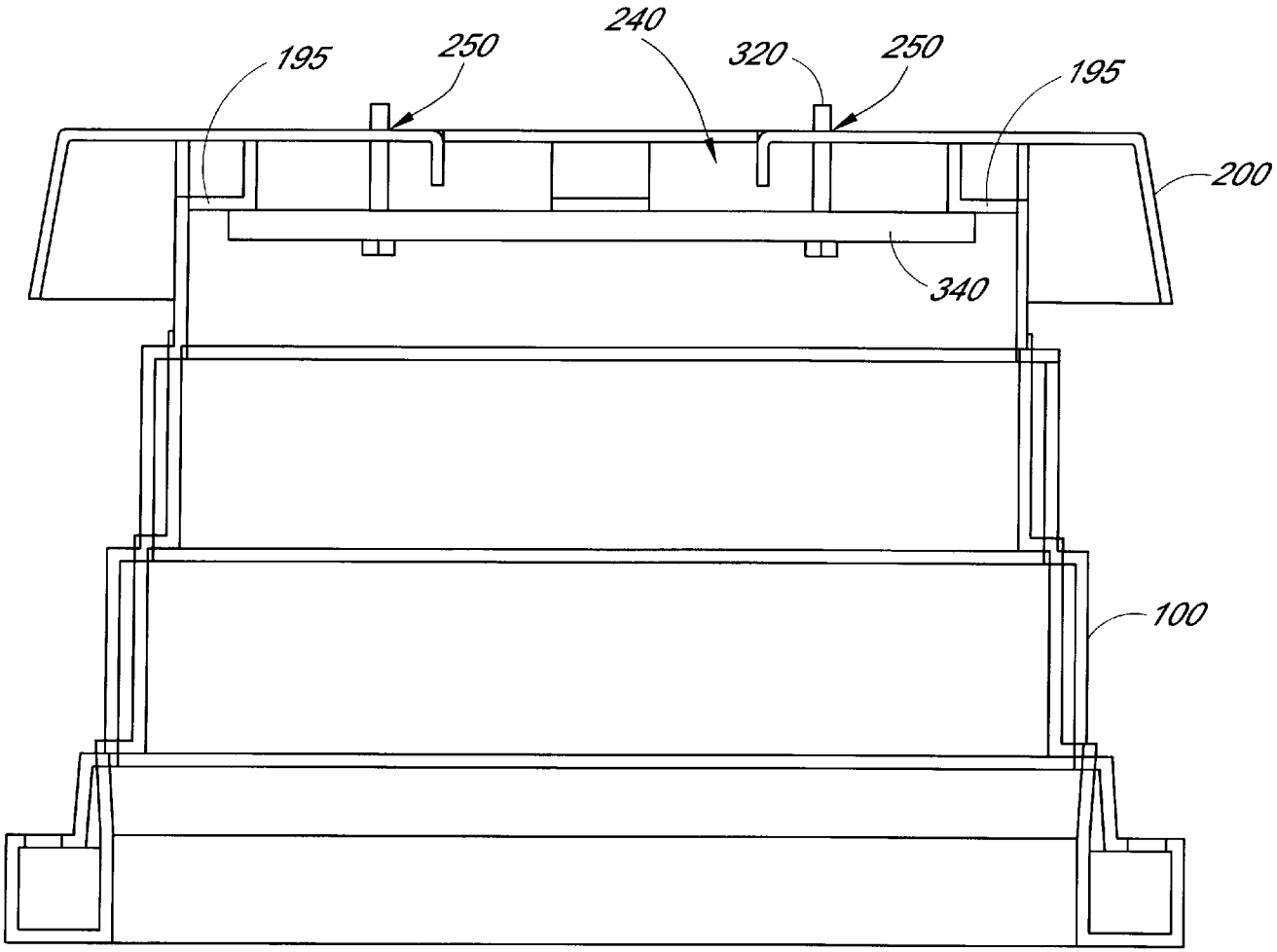
FIG. 5 is cross-sectional view of the enclosure support system of FIG. 3.

The mounting pad 200 is then placed on top of the support base 100. Support braces or clamps 340 are used to secure the support base 100 to the mounting pad 200. As more clearly shown in FIG. 4, the support braces 340 are elongated metal braces, having a U-shaped cross-section. The braces 340 are provided with at least one hole to accommodate fasteners, such as bolts 320. Alternatively, the bolts 320 may be permanently affixed to the support braces 340. All mounting hardware is preferably made of stainless steel to prevent corrosion and rust. As can be seen from FIG. 5, the length of the support braces 340 is sufficient to allow the support braces 340 to span the width of the support base 100 and engage an interior ledge 195 of the support base 100. The interior ledge 195 preferably spans the length of two opposing sides of the support base 100 and is located near the top opening 105 of the support base 100. Preferably, the support braces 340 are installed with the open side of the U-shape contacting the interior ledge 195, as shown in FIG. 4.

The mounting pad 200 is secured to the support base 100 by inserting the fasteners 320 through the holes 250 in the mounting pad 200. Thus, the support braces 340 clamp the interior ledge 195 of the support base 100 between the support brace 340 and the mounting pad 200. The fasteners 320 extend through the holes 250 in the mounting pad 200. The fasteners 320 and, consequently, the support braces 340 are temporarily held in place by the rubber grommets provided around the holes 250 of the mounting pad 200.

Figure 6:
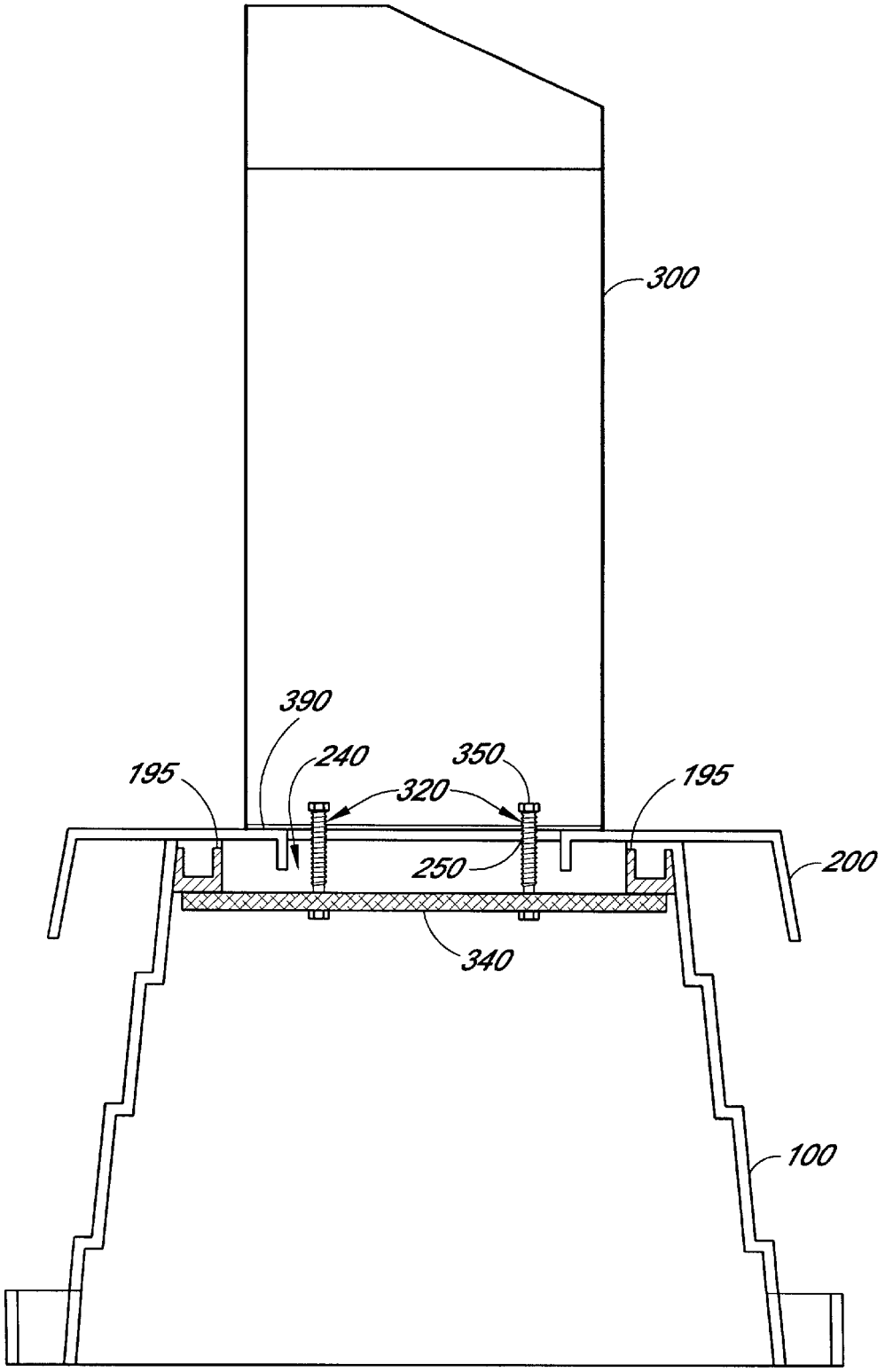
FIG. 6 is a cross-sectional view of the enclosure support system of FIG. 3.

As illustrated in FIG. 6, the enclosure 300 is then mounted on the mounting pad 200. The enclosure 300 is preferably a metal cabinet with a locking door 330 (see FIG. 3). The enclosure 300 is secured to the mounting pad 200 with the fasteners 320. The bolts 320, already inserted through the holes 250 in the mounting pad 200, are positioned in the corresponding holes provided in the base of 390 of the enclosure 300, extending into the interior of the enclosure 300. Nuts 350 are used to secure the bolts 320 in place. The support braces 340, support base 100, mounting pad 200 and the enclosure 300 are thereby secured together. The fasteners 320 are advantageously located inside the enclosure 300, preventing vandals from removing them and accessing or removing the enclosure 300.

Figure 7:
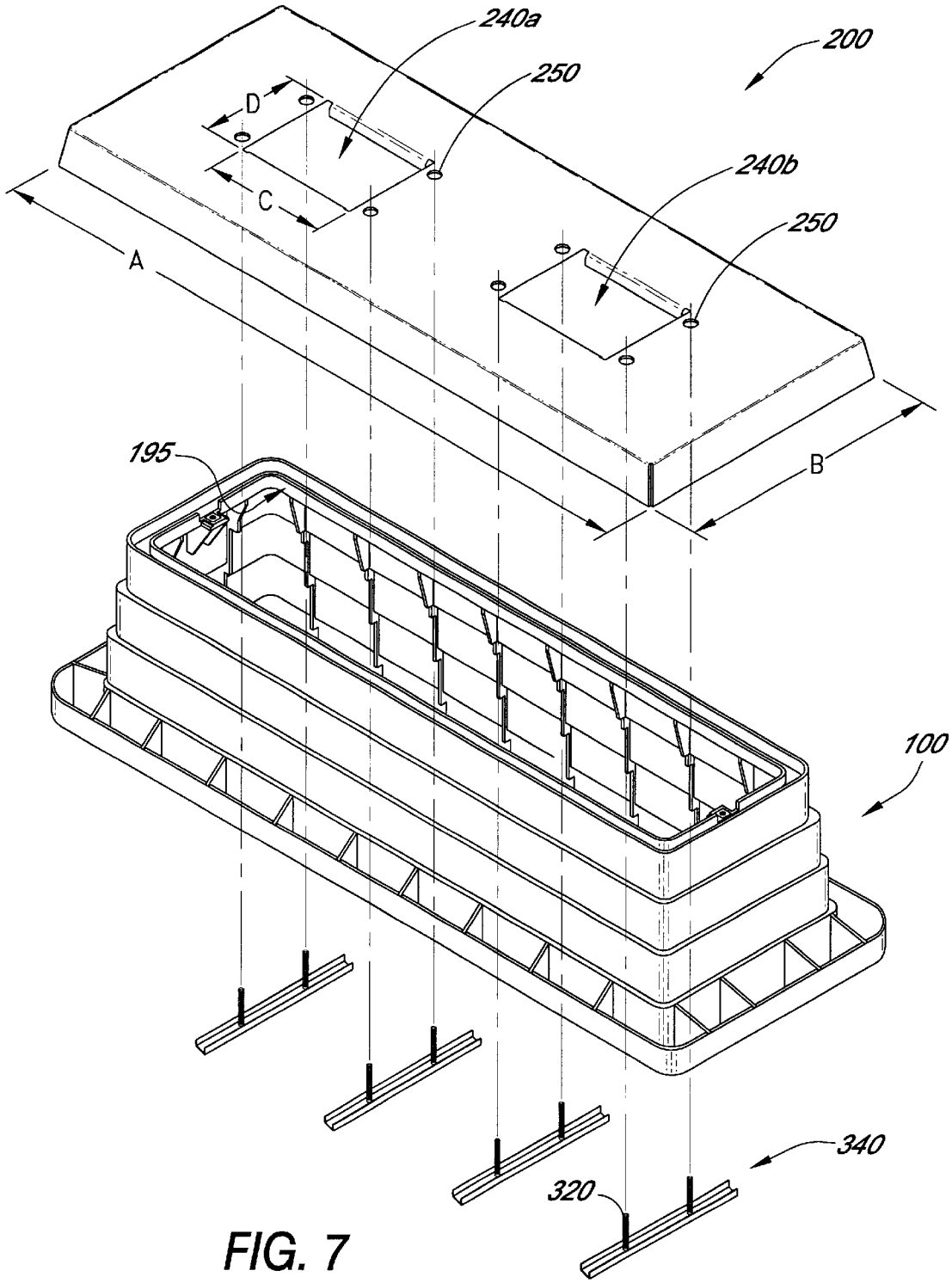
FIG. 7 is an exploded view of another embodiment of an enclosure support system according to the present invention.

As illustrated in FIG. 7, the support base 100 and the mounting pad 200 may be designed to support two or more enclosures. For example, the mounting pad 200 can be provided with two openings 240*a,* 240*b* each with a set of through holes 250. Each opening 240*a,* 240*b* in the mounting pad 200 can be accompanied with a set of support braces 340 and interior ledges 195 in the support base 100. Thus, each opening 240 can accommodate a separate enclosure.

Advantageously, the mounting pad 200 can be provided in a variety of colors adapted to satisfy the varying needs. For example, the mounting pad 200 may be provided in green to match the color of a grassy landscape. Other colors may be used, for example, with desert landscapes.

Thus, the invention provides a secure installation of an enclosure without the need for special preparation of the ground for pouring of concrete. Additionally, the mounting pad is easily manufactured to accommodate a wide variety of support bases and enclosures. Further, the use of the support braces to secure the components of the system eliminates the need for high-precision manufacturing. The installation is made secure by preventing unauthorized access to the mounting hardware.

While the above detailed description has shown, described, and pointed out novel features of the invention as applied to various embodiments, it will be understood that various omissions, substitutions, and changes in the form and details of the device illustrated may be made by those skilled in the art without departing from the spirit of the invention.

What is claimed is:

1. An enclosure mounting assembly, comprising:

a support base having a bottom, a top, and a substantially hollow interior;

a mounting pad resting on said top of said support base, said mounting pad having an opening in a substantially flat top surface; and at least two support braces each having at least one fastener for clamping an upper portion of said support base between said support brace and said mounting pad;

wherein each of said at least two support braces clamps said upper portion of said support base in at least two locations.

2. The assembly of claim 1, wherein said support base has a rectangular footprint.

3. The assembly of claim 1, wherein said support base is made of plastic.

4. The assembly of claim 1, wherein said mounting pad is made of metal.

5. The assembly of claim 1, wherein said mounting pad is made of marine-grade aluminum.

6. The assembly of claim 1, wherein the mounting pad is made of UV-stabilized plastic.

7. The assembly of claim 1, wherein said mounting pad is a rectangular plate.

8. The assembly of claim 1, wherein said at least one fastener is located in the substantially hollow interior of the support base.

9. The assembly of claim 8, wherein said fastener is a nut and bolt assembly.

10. The assembly of claim 8, wherein said mounting pad further comprises a hole in said top surface for receiving said fastener.

11. The assembly of claim 1, further comprising strengthening flanges located on said support base.

12. The assembly of claim 1, wherein the mounting pad rests on a top edge of said support base.

13. The assembly of claim 1, wherein said support brace has a U-shaped cross-section.

14. The assembly of claim 1, wherein said support base further comprises a ledge located on an upper interior surface, wherein said support brace is secured beneath said ledge.

15. The assembly of claim 1, wherein said mounting pad has a plurality of openings in its top surface.

16. An enclosure assembly, comprising:

a support base having a bottom, a top, and a hollow interior;

a mounting pad resting on said top of said support base, said mounting pad having an opening in a top surface; and at least two support braces having at least one fastener for clamping an upper portion of said support base between said support brace and said mounting pad, wherein each of said at least two support braces clamps said upper portion of said support base in at least two locations; and an enclosure having a base mounted on said top surface of said mounting pad, said enclosure having an opening in said base sized so as to surround said opening in said top surface of said mounting pad.

17. The assembly of claim 16, wherein said at least one fastener is located in said interior of said enclosure and secures said support base top, said top surface of said mounting pad and said support brace together.

18. The assembly of claim 16, wherein said enclosure is a metal cabinet.

19. The assembly of claim 17, wherein the mounting pad and the enclosure have at least one hole therein for receiving said fastener.

20. The assembly of claim 16, wherein said mounting pad has a plurality of openings in its top surface.

21. The assembly of claim 16, wherein the fastener is a nut and bolt assembly.

22. The assembly of claim 16, wherein said support base is made of plastic.

23. The assembly of claim 16, wherein said mounting pad is made of metal.

24. The assembly of claim 16, wherein said mounting pad is made of marine-grade aluminum.

25. The assembly of claim 16, wherein the mounting pad rests on a top edge of said support base.

26. The assembly of claim 16, wherein said support brace has a U-shaped cross-section.

27. The assembly of claim 16, wherein said support base further comprises a ledge located on an upper interior surface, wherein said support brace is secured beneath said ledge.

* * * * *